US005718605A

United States Patent [19]

Morikawa et al.

[11] Patent Number: 5,718,605

[45] Date of Patent: Feb. 17, 1998

[54] CONNECTOR SOCKET

[75] Inventors: Seiichi Morikawa, Chiba; Naoyuki Ono, Tokyo, both of Japan

[73] Assignees: SMK Co., Ltd.; Sony Corporation, both of Tokyo, Japan

[21] Appl. No.: 660,951

[22] Filed: Jun. 12, 1996

[30] Foreign Application Priority Data

Jun. 12, 1995 [JP] Japan ..... 7-167884

[51] Int. Cl.[6] ..... H01R 13/648

[52] U.S. Cl. ..... 439/607; 439/108

[58] Field of Search ..... 439/607–610, 439/108, 564

[56] References Cited

U.S. PATENT DOCUMENTS

| | | | |
|---|---|---|---|
| 5,104,333 | 4/1992 | Hatagishi et al. | 439/564 |
| 5,266,053 | 11/1993 | Jarret et al. | 439/607 |
| 5,281,169 | 1/1994 | Kiat et al. | 439/607 |
| 5,288,248 | 2/1994 | Chun | 439/607 |
| 5,388,995 | 2/1995 | Rudy, Jr. et al. | 439/607 |
| 5,397,246 | 3/1995 | Defibaugh et al. | 439/607 |
| 5,417,590 | 5/1995 | Dechelette et al. | 439/607 |

*Primary Examiner*—Hien Vu

*Attorney, Agent, or Firm*—Lowe, Price, LeBlanc & Becker

[57] ABSTRACT

A connector socket features a shield case 44, an upper lid of the shield 45, and a shield base plate 46 which are each made of conductive metal plate, and which enclose and cover a housing 43 in such a way that the housing 43, which is composed of the insulating material, can be connected to a wiring plate 14. The shield case 44 includes a side plate portion 58 which fits along both sides of the housing 43 in a manner which engages centrally located engaging portion 56, a lid which covers the upper portion of the shield case 44, and a shield base which is applied to the lower surface of the housing 43. The three pieces are fixed by way of screw fastening pieces 74, 61 and 69 which are respectively integral with the shield case 44, upper lid of the shield 45 and the shield base plate 46, into a single unit and has a connection piece 62 which is integral with the shield base plate 46 and which extends from one side of the shield case and contacts the wiring plate 14.

8 Claims, 9 Drawing Sheets

CONNECTOR SOCKET

BACKGROUND OF THE INVENTION (1) Field of the Invention

This invention relates to a connector socket for the transmission of VTR, TV, CD player, tuner, amplifier, etc. type signals wherein the socket is composed of a connector plug and a connector socket.

(2) Description of the Prior Art

In general, a connector 10 is, as shown in FIG. 9, composed of a connector socket 12 installed on a chassis and a connector plug 11 mounted at the end of a cable 25.

The connector plug 11 has plural contacts 23 at the inside open front of a housing 22. The outer periphery of this housing 22 is covered by a metal shell 32. The plural contacts 23 are each connected to a signal conductor and power line of the cable 25. This connecting portion is covered with a cover 24.

Further, to ensure contact when fitting the connector 11 into the connector socket 12, a bulging-out portion or protuberance 35, which is resilient, is formed on either side of the top and central portions of both the top face and the bottom face of metal shell 32, respectively.

The connector socket 12 has a socket fitting 16 which is inserted through a port 15 of a chassis 13, and mounted facing the opening portion of this socket fitting 16. This connector socket 12 is fixedly mounted on the edge of a wiring plate 14 by way of screws 20. The end portion of a terminal 18 is connected to a conductive foil or strip 21 using solder 19.

When inserting the connector plug 11 into the connector socket 12 mounted as mentioned above, since the metal shell 32 is included in the socket fitting 16, and the contact 23 is in contact with the contact portion of the terminal 18, an electrical connection is established.

In case the connector plug 11 is inserted into the connector socket 12, the conventional connector socket 12 fixes only the substantially intermediate portion of a housing 17 to the wiring plate 14 using the right and left screws 20. For this reason, should an external force be applied to the connector plug 11 in a direction intersecting the direction of insertion, an angular moment is generated in the connector socket 12 using the screws 20 as a fulcrum, and there is a problem that the terminal portion of the terminal 18 is exfoliated (viz,. disconnected) from the conductive foil or strip 21.

Moreover, since the housing 17 of the conventional connector socket 12 is not provided with adequate shielding, there is a problem that noise is likely to become mixed with the signals which are being transmitted.

BRIEF SUMMARY OF THE INVENTION

The first object of this invention is to provide a connector socket wherein the terminal portion of the terminal is prevented from being detached the conductive foil when the connector plug is inserted into the connector socket and wherein the mounting to the wiring plate 14 of the connector socket is more securely connected.

The second object of this invention is to provide a connector socket that can assuredly prevent the admix of noise at the point of connection.

This invention relates to a connector socket which features a shield case 44, an upper lid of the shield 45, and a shield base plate 46 which are composed of a conductive metal plate, and which enclose and cover a housing 43 in such a way that the housing 43, which is composed of the insulating material, can be connected to a wiring plate 14. The shield case 44 includes a side plate portion 58 which fits along both sides of the housing 43 in a manner which engages centrally located engaging portion 56, a lid which covers the upper portion of the shield case 44, and a shield base which is applied to the lower surface of the housing 43. The three pieces are fixed by way of laterally extending portions or screw fastening pieces 74 (first and second laterally extending portions), 61 (third and fourth laterally extending portions) and 69 (fifth and sixth laterally extending portions) which are respectively integral with the shield case 44, upper lid of the shield 45 and the shield base plate 46, into a single unit and has a connection piece 62 which is integral with the shield base plate 46 and which extends from one side of the shield case and contacts the wiring plate 14.

As mentioned above, since a connector socket 42 is mounted into the wiring plate 14 by two screws 20 and is provided with connection pieces 62 in two places, even if an external force is applied in a direction intersecting the direction of insertion, it is possible to prevent terminal portions 53 of a terminal 47 from being exfoliated or torn free of conductive strips.

Further, since the housing 43 is surrounded by the shield case 44, upper lid of the shield 45, shield base plate 46 and chassis 13, the mixing of the noise can be surely prevented.

Other objects of the invention will become more apparent from the detailed description which follows.

BRIEF DESCRIPTION OF THE DRAWINGS

FIG. 8(*b*) is a side view the cable shown in FIG. 8(*a*);

FIG. 8(*c*) is a cross-sectional view showing a variant of the cable shown in FIG. 8(*a*)

DETAILED DESCRIPTION

An embodiment of this invention will be explained on the basis of FIG. 1 to FIG. 8.

Figure 2:
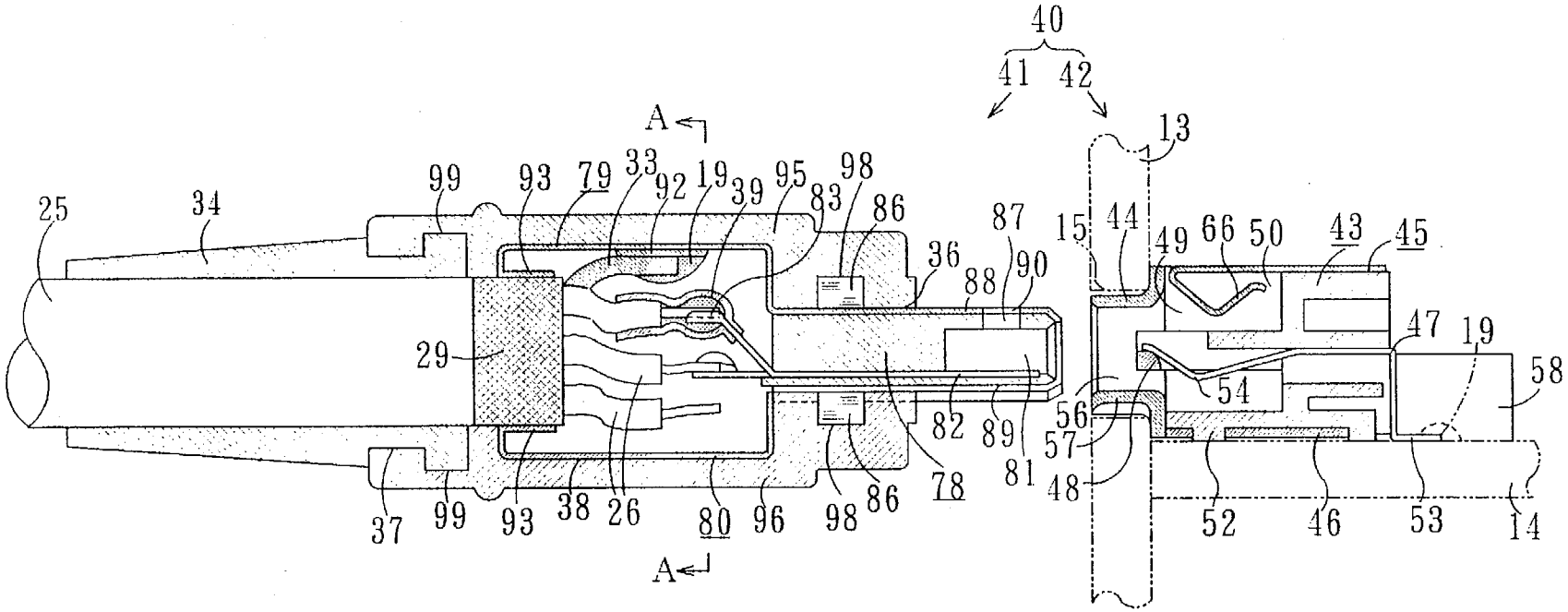
FIG. 2 is a cross-sectional view of a connector socket and connector plug for insertion into this connector socket.

As shown in FIG. 2, the numeral 40 denotes a connector. This connector 40 is composed of a connector plug 41 and a connector socket 42.

Figure 1:
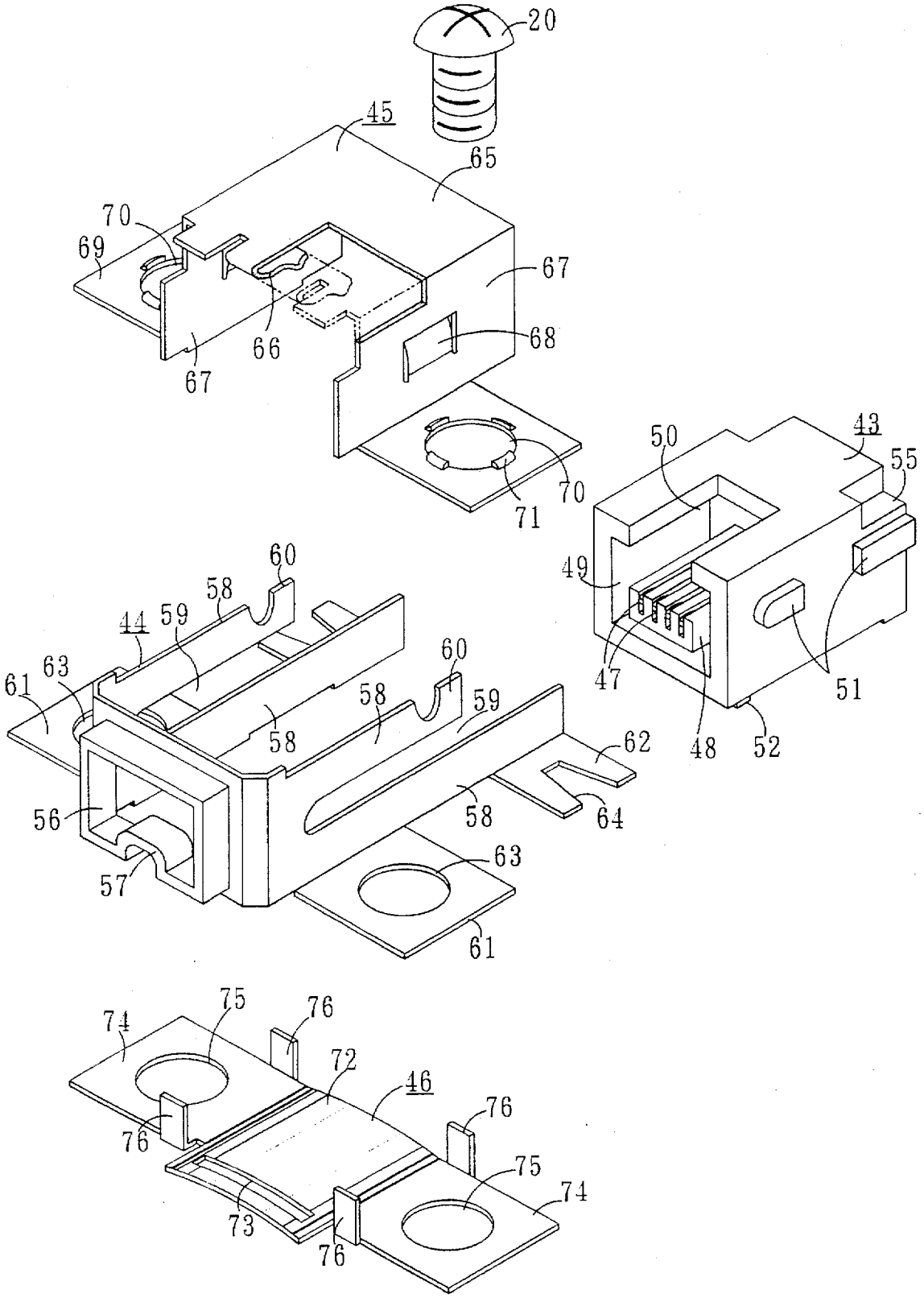
FIG. 1 is an exploded perspective view showing an embodiment of the connector socket according to this invention.

Details of the connector socket 42 will be firstly explained with reference FIG. 1.

The connector socket 42 according to the present invention, is composed of a housing 43 made of an insulating resin, a shield case 44 made of the conductive metal plate, an upper lid of the shield 45 made of the conductive metal plate and a shield base plate 46 made of the conductive metal plate.

The housing 43 is adapted to receive a protruding terminal portion of the connector plug 41 in a front opening 49 wherein plural terminals 47 are arranged at predetermined intervals on a terminal receiving portion 48. The top face of these terminals 47 becomes a contact portion 54 by protruding a little above the terminal receiving portion 48. On the other hand, the other edges of the terminals protrude from the back portion of the housing 43, resulting in the terminal portions 53.

In the upper face of this housing 43, a top face notch 50 is formed from the front edge. Along the side faces, two protruding portion 51 are horizontally arranged with clearance for an engaging click 68 described below, therebetween. Further, in each of the rear corners is an engaging concave portion 55. The bottom surface is provided with a positioning projection 52 which extends across the lower face of the housing.

The shield case 44 is formed with a central engaging portion 56 by drawing conductive metal plate which includes an insertion direction determining projection 57 at the bottom. The side plate portion 58 is folded and formed backward from both sides of this engaging portion 56, while a slot 59 is formed from the back edge in this side plate portion 58. A tongue 60 is formed at the back upper edge of this side plate portion 58. Further, along each bottom edge of the plate portion 58 are a screw fastening piece 61 and a fixing piece 62 which are bent so as to extend out laterally from the plate portion 58 (seventh and eighth laterally extending portions). The screw fastening piece 61 includes a tapped hole 63 while the fixing piece 62 includes a V-shaped notch 64.

The upper lid of the shield 45 is formed of a conductive metal plate, and is folded in the downward ~]~-letter type shape without a bottom. The front edge part of the upper face portion 65 is folded by approximately 180 degrees back into its interior to form an integral half locking piece 66. Moreover, an engaging click 68 is cut and formed in a side plate portion 67 on both sides. A screw fastening piece 69 is folded outward from the bottom edge of each side plate portion 67. A tapped hole 70 is drilled into each of the fastening pieces 69 and for increased reliability at the time of screwing, plural projections 71 are formed about the tapped holes 70.

The planar part between the top face portion 65 of this upper lid of the shield 45 and the top face portion of the housing 43, is formed as wide as possible, widening the adsorbing face at the time of automatic assembling.

The shield base plate 46 is made of a long narrow conductive metal plate, of which central portion is formed with an upwardly extending convex bottom 72 on which a positioning hole 73 is formed. A tapped hole 75 is drilled in each of the laterally extending portions or screw fastening pieces 74. Caulking pieces 76 positioningly protrude upward from each side edges of the screw fastening pieces 74.

Next, the assembling order of the connector socket 42 will be explained with reference to FIGS. 1 to 4.

The housing 43 is fitted in such a way that the mating projection 51 is guided to the slot 59 from the rear of the shield case 44, and after fitting, it is fixed by folding the tongue 60 into the fixing concave portion 55. This directs the terminal receiving portion 48 toward the front of the engaging portion 56.

The upper lid of the shield 45 is then disposed over the top of the shield case 44. The side plate portion 67 of the upper lid of the shield 45 is slipped over the outside of the side plate portion 58 of the shield case 44, allowing the engaging click 68 to become engaged in the concave portion formed in the clearance between the slot 59 and two pieces of convex mating projection 51. At the same time the half locking piece 66 is freely engaged in the top face notch 50 of the housing 43, the tapped holes 63 are mated with the tapped holes 70, and the screw fastening piece 61 and the screw fastening piece 69 overlapped one another.

Then, the shield base plate 46 is fitted in such a way that the projection 52 on the bottom face of the housing 43 becomes fitted in the positioning hole 73.

Next, after ensuring that the tapped holes in the three pairs of screw fastening pieces 74, 61 and 69 are closely aligned, the screw fastening pieces are fixed together by folding the top face of the caulking piece 76 over.

Figure 3:
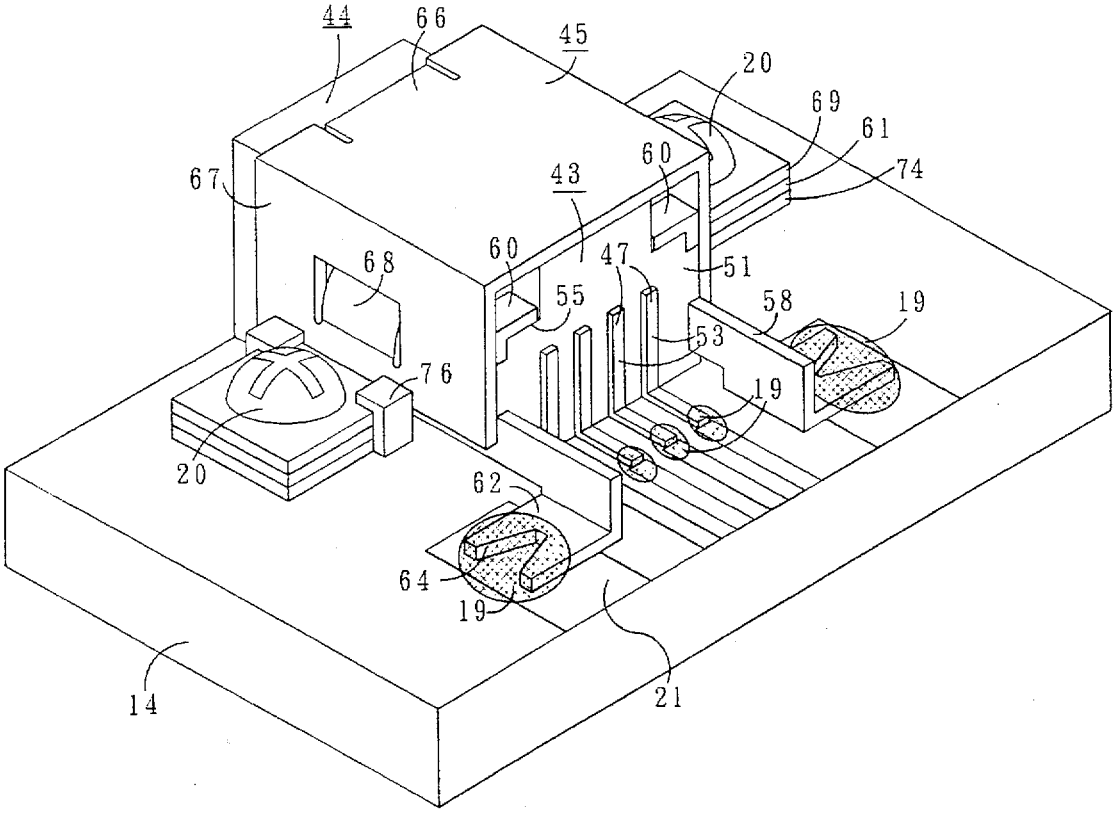
FIG. 3 is a perspective view showing the connection of the connection socket to the wiring plate in accordance with the present invention.
Figure 4:
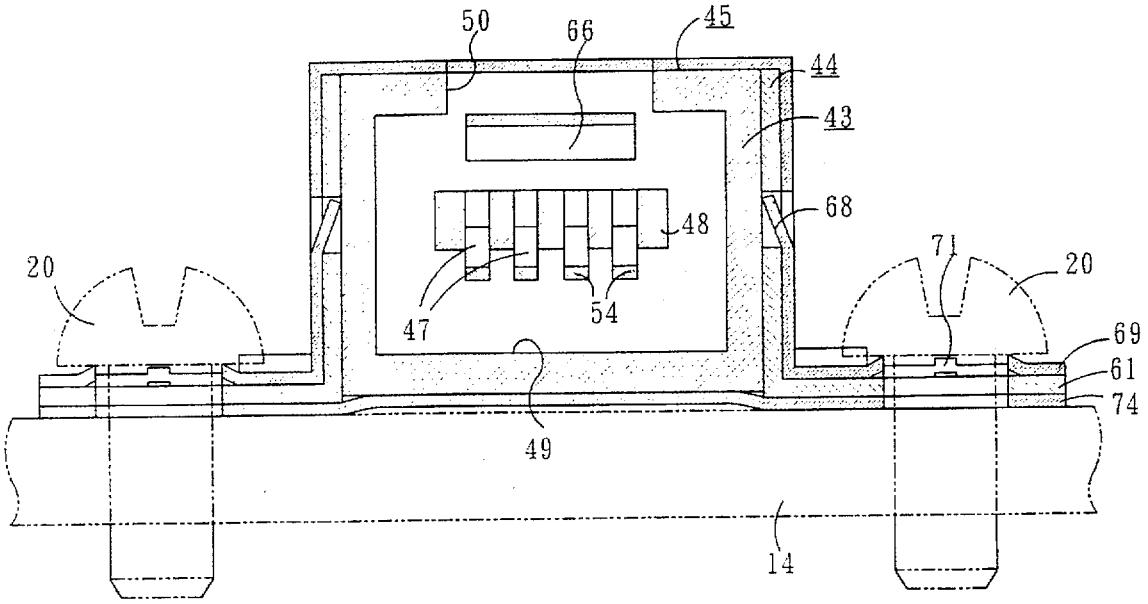
FIG. 4 is a cross-sectional view showing the connection between the wiring plate and the connector socket according to this invention.

The connector socket 42 then assembled in such a way that the engaging portion 56 fits through a hole 15 formed in the chassis 13, as shown in FIG. 2 to FIG. 4, as well as being located in a specified position of the wiring plate 14, and is fixed in position with screws 20. The fixing pieces 62 are then connected using solder 19, as are the terminal portions 53 of the terminals 47.

As mentioned above, the connector socket 42 is mounted on the chassis 13 using the two screws 20 and by soldering the fixing pieces 62 in two places. For this reason, if an external force is applied in the direction intersecting with the direction of insertion in the connector plug 41, the terminal portion 53 of the terminal 47 will not be torn free or exfoliated from the conductive foils 21. Further, since the housing 43 is surrounded by the shield case 44, the upper lid of the shield 45, the shield base plate 46 and the chassis 13, noise is prevented from contaminating the signals being transmitted by way of the terminals 47.

The four parts of the housing 43, viz., the shield case 44, upper lid of the shield 45, and shield base plate 46 are, firmly assembled without clearance due to the curved nature of the bottom 72 of the shield base plate 46 and the caulking pieces 76. Therefore, when placing the unit on the wiring plate 14 and connecting and fixing them by the solder 19, there is no way that the solder 19 flows in the clearance, and reliability is improved.

Figure 5:
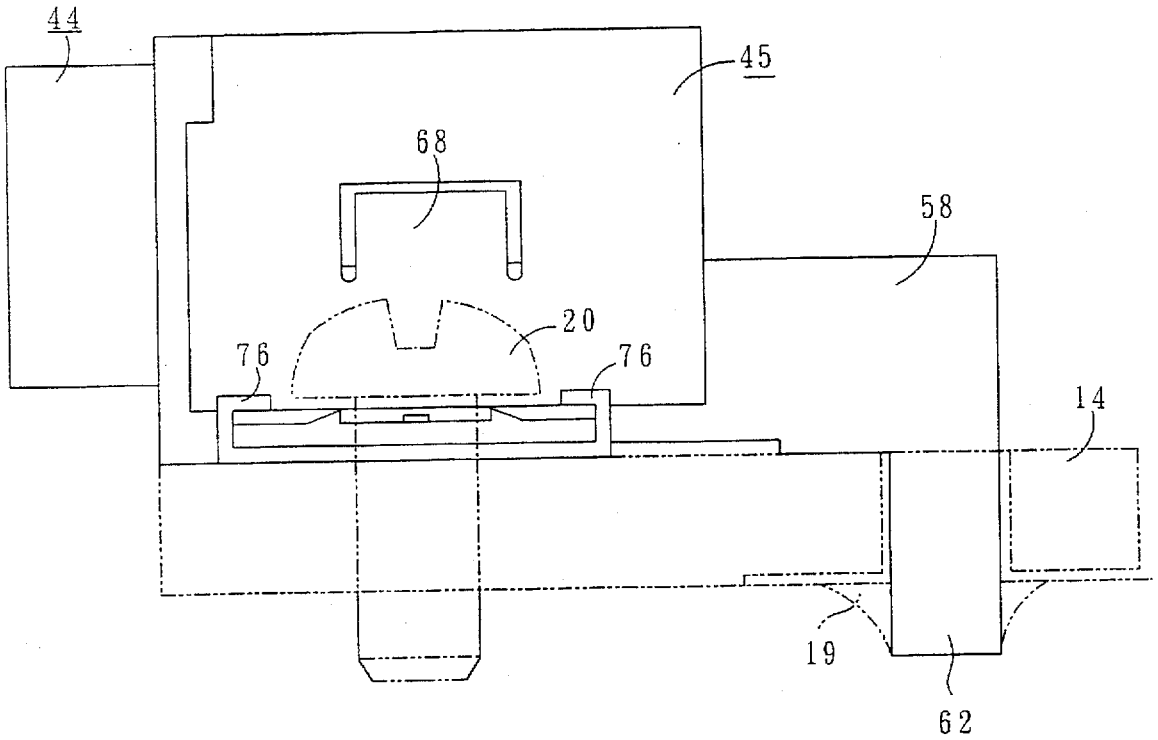
FIG. 5 is a side view showing a variant of the connection between a connector socket and the wiring plate which is possible with the present invention.

Still more, it is possible that the fixing pieces 62 installed on the side plate portion 58 of the shield case 44, are neither folded nor formed outward as shown in FIG. 3, and the invention is not limited to the case wherein they are fixed to the top face of the wiring plate 14, and, as shown in FIG. 5, the fixing pieces 62 of the side plate portion 58 may be left unfolded and formed downward, so as to protrude through the bottom face from the through holes of the wiring plate 14, and fixed by the solder 19 to a connective film formed on the lower face of the plate.

Figure 6:
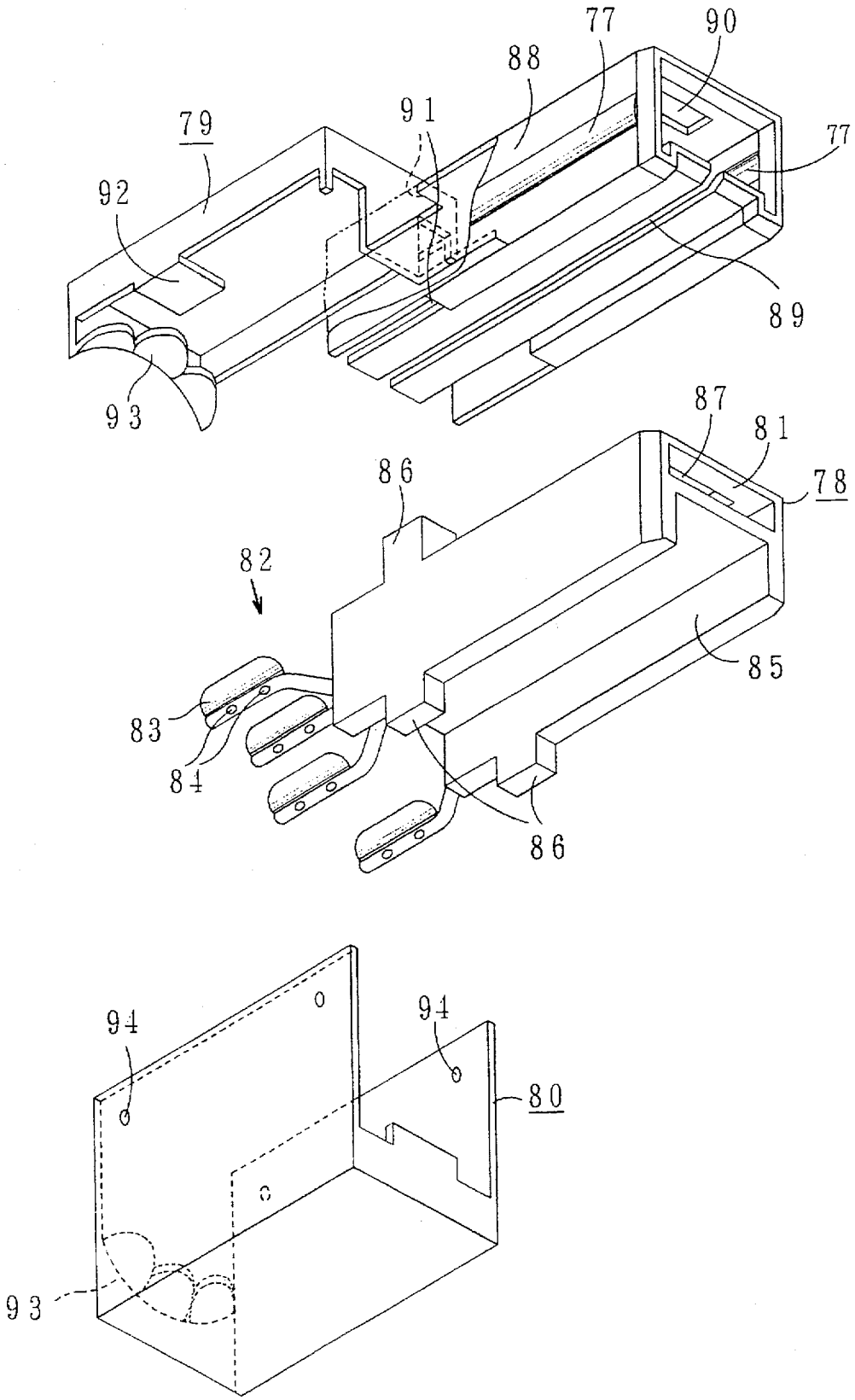
FIG. 6 is an exploded perspective view of a connector plug shown in FIG. 2.
Figure 7:
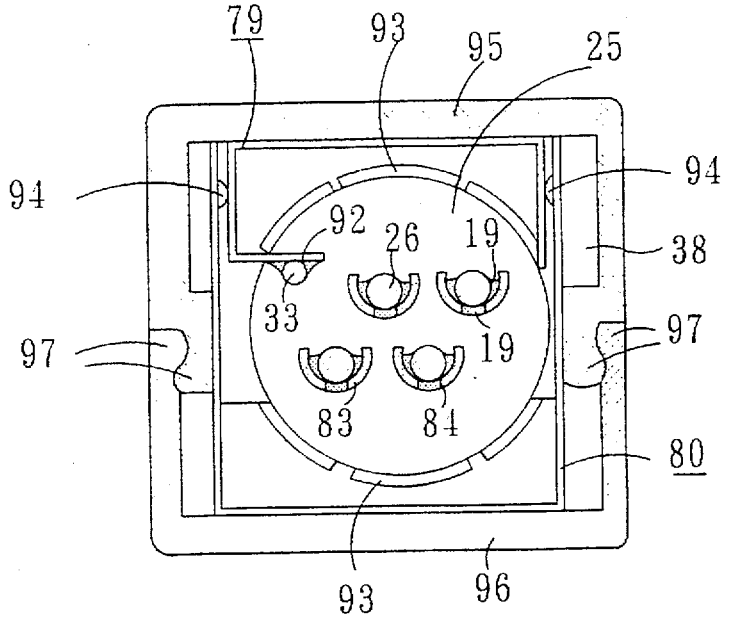
FIG. 7 is a cross-sectional view of the connector plug shown in FIG. 2 as taken along section line A—A of FIG. 2.

The connector plug 41 is constituted by a housing 78 made of the insulating resin as shown in the exploded perspective view of FIG. 6. An upper shield case 79 is made of the same conductive metal plate, as the lower shield case 80. Upper and lower covers 95, 96 are made of an insulating resin as shown in FIG. 2 and FIG. 7.

The housing 78 has a socket engaging hole 81 in the front, is formed with a bottom groove 85 in the longitudinal direction in the bottom face, has a half locking hole 87 drilled in the top face, slip-out projections 86 extending vertically in the rear, and chamfering at the front edge. Moreover, the ends of a plurality of contacts 82 are arranged at the socket engaging hole 81 end of the housing 78 which is designed in such a way that the other end of the contacts 82 extend out the rear. The contacts are molded into place to form a unit.

A terminal portion 83 is provided on the trailing end of each contact 82. This terminal portion 83 has, as shown in FIG. 6 and FIG. 7, a semi-circular shape and has a diameter which is a little larger than the signal conductor 26 to which it is connected. Small holes 84 are drilled in each terminal portion to permit molten solder 19 to flow spontaneously in, but prevent the same from flowing out again.

Specifically, if the diameter of the signal conductor 26 is 0.3 mm, the diameter of the semi-circular part of the terminal portion 83 should be of approximately 1.0 mm. The diameter of the small holes 84 should be of approximately 0.3 mm. Since these terminal portions 83 are arranged at close intervals, it is desirable that they are folded alternately up and down, and from side to side.

The upper shield case 79 is defined by a one-piece, metal shell portion 88. Since this metal shell portion 88 is inserted into the housing 78 from the rear, it has a substantially angular square-shaped form. However, the bottom is folded to form a small groove which fits over the bottom groove 85. Additionally, drilled divisions 89 which allow for distortion to be absorbed even though the metal shell portion 88 itself has elasticity, are formed with clearance in the length direction.

More specifically, as shown in FIG. 6, an elastically deformable portion 77 which bulges out on both side portions of the metal shell portion 88, is provided in the longitudinal direction (the direction of insertion of the connector plug 41). Alternatively, although not illustrated, the elasticity portion 77 may be folded outward from the lower part of both side portions of the metal shell portion 88 may be provided in the longitudinal direction (direction of insertion of the connector plug 41). Then, when this metal shell portion 88 is fitted to the connector socket 12, the entire metal shell portion 88 is press-connected to the engaging portion 56 of the shield case 44 while elasticity deforming the elasticity portion 77. At this time, the drilled divisions 89 permit distortion.

In the upper plate of the metal shell portion 88, a half locking holes 90 is drilled, or in the upper plate and lower plate, a notch 91 is formed so that the slip-out portions 86 will protrude.

The back end part of the upper shield case 79 is of a shallow lid type having an upper plate and side plates, and includes integral semi-circular portions 93 which are folded inwardly from the back end and a side plate connecting terminal portion 92 folded to the inside from the side direction. The lower shield case 80 forms a lidless box type structure having a base plate, sides, and integral semi-circular portions 93 which are folded to the inside from the back end. Inwardly extending projections are provided on the right and left sides of the lower shield case to assure contact with the upper shield case 79.

The upper cover 95 and lower cover 96 are, as shown in FIG. 2 and FIG. 7, horizontally divided into two and substantially prismatic, provided with engaging portions 97 at the engaging part of both sides, formed with angular holes 36 in the front, round holes 27 in the back face, and the hollow portions 38 in the interior. Further, in the inner walls of both the angular holes 36 and the round holes 37, the engaging grooves 98 and the engaging grooves 99 are formed, respectively.

The order in which each of the above connector plug 41 parts are assembled will now be explained.

Figure 8:
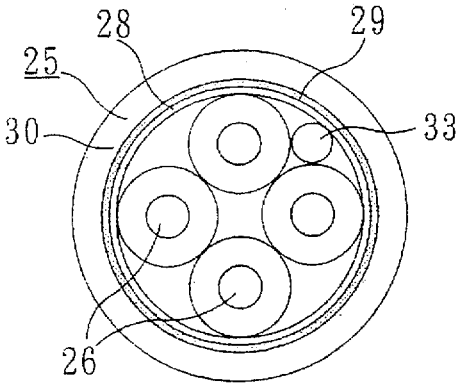
FIG. 8(*a*) is a cross-sectional view of the cable connected to the connector plug.
Figure 8:
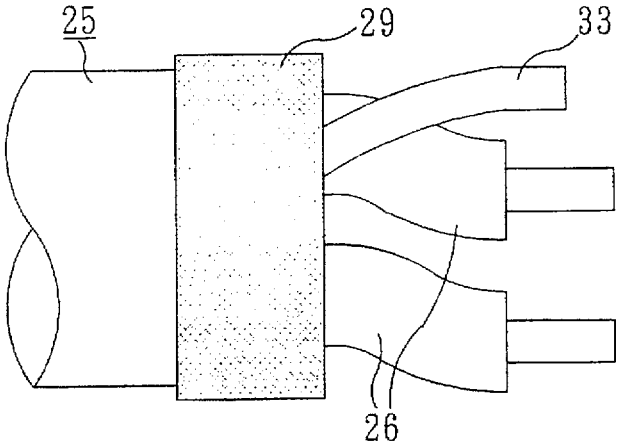
Figure 8:
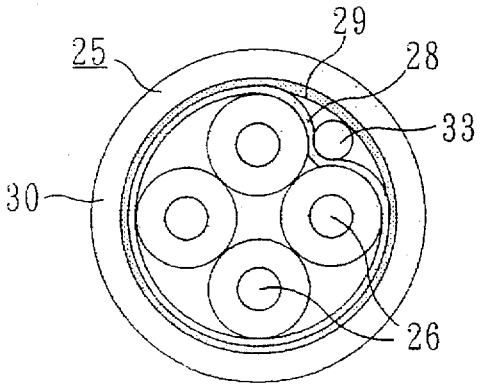
Figure 9:
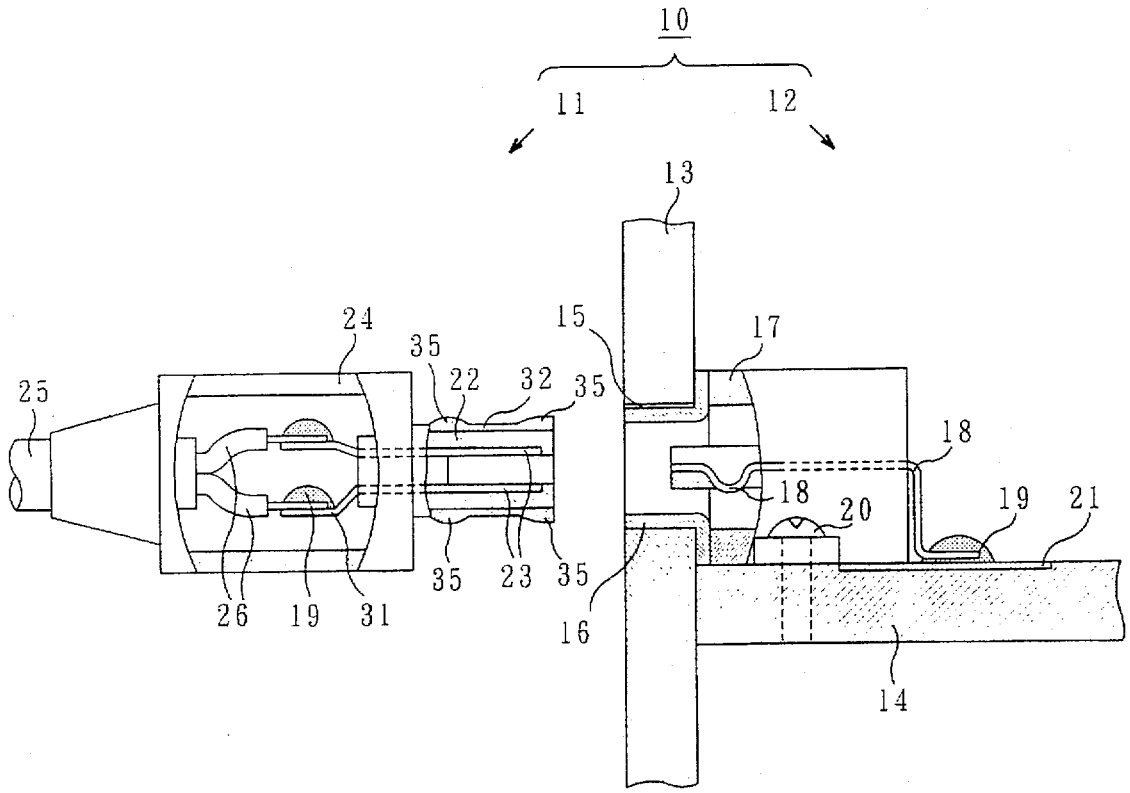
Fig. 9 PRIOR ART
FIG. 9 is a cross-sectional view of a conventional connector plug and connector socket discussed in the opening paragraphs of the instant disclosure.

First, as shown in FIGS. 2 and 8, the cable 25 is disposed through a one-piece bush or grommet 34, the signal conductors 26 and a grounding wire 33 are exposed, a shield 29 is wrapped around the outer circumference of an insulating jacket 30, and insulating tubes 39 are slipped over the signal conductors 26 to complete the process.

The grounding wire 33 is inserted between a conductive tape 28 along with the signal conductors 26 as shown in FIG. 8(*a*) while, in an alternative arrangement, it is inserted between the shield 29 and the conductive tape 28 as shown in FIG. 8(*c*).

Then, the signal conductors 26 are placed one after other into the terminal portion 83 of the contact 82, and connected by solder 19. It is then confirmed from the bottom face of the terminal portion 83 whether the solder 19 has flown also in the small holes 84.

After connection, the insulating tubes 39 are disposed over the connection sites and heated. This thermally shrinks the tubes 39 and causes them to closely adhered to the signal conductors 26 or the terminal portions 83, and protected against short-circuit and/or disconnection.

The housing 78 connected to the signal conductor 26 is inserted from the back end into the metal shell portion 88 of the upper shield case 79, and press-fitted until the slip-out projections 86 are properly received in the notch 91. After this, the grounding wire 33 is connected to the connecting terminal portion 92 by solder 19.

Then the lower shield case 80 is fitted to the upper shield case 79. At this time, the shield 29 which is wrapped around the outside of the insulating jacket 30 is in contact with the semi-circular portions 93 of the upper shield case 79 and the semi-circular portions 93 of the lower shield case 80, as well the projection 94 of the lower shield case 80 which is press-connected to the side plate of the upper shield case 79.

Moreover, the upper cover 95 covers the upper shield case 79, the lower cover 96 covers the lower shield case 80, and the upper and lower engaging portions 97 are press-fitted and engaged. Then, the slip-out projection 86 is fitted into an engaging groove 98, and the upper shield case 79 and the lower shield case 80 are fitted to the hollow portion 38, wherein the tip portion of a bush 34 is fitted to the engaging groove 99, the tip portion of the metal shell portion 88 is protruded from the angular hole 36, and the assembly of the connector plug 41 is completed.

When inserting the connector plug 41 constituted as mentioned above into the connector socket 42, the metal shell portion 88 of the upper shield case 79 is fitted to the engaging portion 56 of the shield case 44. At this time, the connector plug 41 is inserted only if the bottom groove 85 will fit into the inserting direction determining projection 57, and cannot be inserted if it is turned upside down.

When the metal shell portion 88 is inserted into the engaging portion 56, due to the elasticity of portion 77, as the metal shell portion 88 exhibits elasticity, which enables distortion, when the metal shell portion 88 is pressed inward, the distortion is absorbed by the drilled divisions 89, and the metal shell portion 88 and engaging portion 56 becomes snugly engaged.

When the metal shell portion 88 is further inserted, the contact 82 engages the contact portion 54 of the terminal 47 and is assuredly electrically connected. The half locking piece 66 of the upper lid of the shield 45 fits into the half locking hole 90 of the metal shell portion 88 and the half locking hole 87 of the housing 78, and the connector plug 41 becomes half locked to the connector socket 42.

When inserting or removing the connector plug 41 from the connector socket 42, even though an external force is applied in a direction intersecting the direction of insertion, since the connector socket 42 is not fixed only with screws 20, but also fixed with fixing pieces 62 of the shield case 44, no terminal portion 53 of the terminal 47 is exfoliated, and therefore withstands the use for long periods of time.

The connector socket 42 of this invention the housing 43 made of the insulating material is covered with the shield case 44 made of the conductive metal plate, the upper lid of the shield 45 and the shield base plate 46, which each have integral connection or screw fastening pieces 74, 61 and 69. The shield case is further provided with an integral fixing piece 62 which can be connected to the wiring plate 14.

For that reason, at the time of insertion and removal of connector socket 42 of the connector plug 41, even though an external force is applied in a direction intersecting the direction of insertion no terminal portion of the terminal 47 is exfoliated from the conductive foil 21.

Moreover, the housing 43 of this invention is provided with the top face notch 50 formed in the upper plate portion and two mating portions 51 on either side. The shield case 44 is provided with a slot 59 to receive the mating portion 51 to the side plate portion 58; the upper lid of the shield 45 is provided with engaging clicks 68 which engaging in the concavities or clearances between the slot 59 and two mating projections 51 when covered from upward the shield case 44.

For this reason, the process of assembling the housing 43, the shield case 44, the upper lid of the shield 45 and the shield base plate 46 is simple and easy.

Further, the shield base plate 46 of this invention is provided with the convex bottom 72, as well provided with the caulking piece 76 which project upward to connect the screw fastening pieces 74, 61 and 69 respectively formed integrally with the shield case 44, the upper lid of the shield case 45 and the shield base plate 46. For this reason, the bottom of the housing 43 is pressed-in the part of the concave bottom 72, the top face of the housing 43 is press-connected to the inner face of the top face portion 65 in the upper lid of the shield 45 and mounting can be made without clearances. Further, as the three pairs of laterally extending portions or screw fastening pieces 74, 61 and 69, fit snugly on top of each other, folding and fixing the tip of the caulking piece 76, there is no way that the shield case 44 and upper lid of the shield 45 can shift to the right or left after assembling. Further, since by the concave bottom 72 of the shield base plate 46 and caulking piece 76, the shield case 44, upper lid of the shield 45 and shield base plate 46 of the housing 43 are firmly assembled without clearances, when placing them onto the wiring plate 14, connecting them by the solder 19 and fixing them, no solder 19 is found to flow in the clearances, and reliability is improved.

What is claimed is:

1. An electrical connector comprising:

a housing formed of an electrically insulative material;

a shield base plate disposed on a wiring plate, said shield base plate being made of an electrically conductive material and having first and second connection openings formed in first and second laterally extending portions which are integral with the shield base plate and which lie directly on the wiring plate;

a shield case made of an electrically conductive material which is adapted to receive said housing therein, said shield case having third and fourth connection openings formed in third and fourth laterally extending portions which are integral with said shield case and which lie directly on said first and second laterally extending portions so that said third and fourth connection openings are aligned with said first and second connection openings respectively; and a shield lid formed of an electrically conductive material which is adapted to fit over said shield case and to have fifth and sixth laterally extending portions which lie directly on said third and fourth laterally extending portions of said shield case, the fifth and sixth laterally extending portions being formed with fifth and sixth connection openings which are aligned with said third and fourth connection openings respectively;

said shield base plate, said shield case and said shield lid cooperating to define a structure which secures said housing therewithin in position on the wiring plate, and which is adapted to be held in position on the wiring plate by first and second screws, the first screw passing through said first, third and fifth connection openings, the second screw passing through said second fourth and sixth connection opening, wherein said shield case is formed with a slot which is adapted to slidably receive a projection formed on a side of said housing and wherein said shield lid is formed with an opening which is adapted to provide a click which engages the side of the housing.

2. An electrical connector as set forth in claim 1, wherein said shield case further comprises a seventh laterally extending portion which is integral with said shield case and which is adapted to rest on the wiring plate and to be electrically connected with a thin strip of electrically conductive material which is disposed on the surface of the wiring plate.

3. An electrical connector as set forth in claim 2, wherein said shield case further comprises an eighth laterally extending portion which is integral with said shield case and which is adapted to rest on the wiring plate and to be electrically connected with a second thin strip of electrically conductive material which is disposed on the surface of the wiring plate.

4. An electrical connector as set forth in claim 1, wherein said shield base plate is formed with a convex portion which curves upwardly from the wiring plate to engage a lower surface of said housing.

5. An electrical connector as set forth in claim 1, wherein said shield base plate is formed with upwardly projecting pieces which extend up on either side of the third and fourth and the fifth and sixth laterally extending portions in a manner to located the third and fourth and the fifth and sixth laterally extending portions in positions wherein the third and fifth connection openings are aligned with the first connection opening and wherein said fourth and sixth connection openings are aligned with the second connection opening.

6. An electrical connector as set forth in claim 1, wherein said shield lid is formed with an inwardly curved portion which is adapted to engage a portion of a shield member disposed on a male plug member which is arranged to be inserted into a female connection socket portion formed in said housing.

7. An electrical connector as set forth in claim 1, wherein the fifth and sixth connection openings formed in said shield lid include means for operatively engaging the thread of the first and second screws.

8. An electrical connector as set forth in claim 1, wherein said shield case further comprises a seventh portion which is integral with said shield case and which is adapted to extend through an opening in the wiring plate and to be electrically connected with a thin strip of electrically conductive material which is disposed on an opposite surface of the wiring plate.

* * * * *